US006146180A

United States Patent [19]

Betker et al.

[11] Patent Number: 6,146,180

[45] Date of Patent: Nov. 14, 2000

[54] CONNECTOR LATCH WITH INTEGRATED AUXILIARY CONTACTS

[75] Inventors: Jay Brian Betker, Yorba Linda; Rene Augusto Mosquera, Laguna Niguel, both of Calif.

[73] Assignee: ITT Manufacturing Enterprises, Inc., Wilmington, Del.

[21] Appl. No.: 09/439,125

[22] Filed: Nov. 12, 1999

[51] Int. Cl.[7] ..... H01R 13/627

[52] U.S. Cl. ..... 439/352; 439/350

[58] Field of Search ..... 439/352, 353, 439/265, 259, 350, 357, 358, 488, 489, 372

[56] References Cited

U.S. PATENT DOCUMENTS

| | | | |
|---|---|---|---|
| 1,978,076 | 10/1934 | Cassedy, Jr. | 173/330 |
| 2,516,148 | 7/1950 | Rose et al. | 200/115.5 |
| 2,674,723 | 4/1954 | Hurlbut | 339/176 |
| 2,755,452 | 7/1956 | Rogie | 339/196 |
| 4,026,623 | 5/1977 | Goodman et al. | 339/75 |
| 4,838,808 | 6/1989 | Fujiura | 439/357 |
| 5,310,352 | 5/1994 | Mroczkowski et al. | 439/76 |
| 5,356,300 | 10/1994 | Costello et al. | 439/101 |
| 5,411,402 | 5/1995 | Bethurum | 439/77 |
| 5,478,253 | 12/1995 | Biechler et al. | 439/181 |
| 5,518,416 | 5/1996 | Kantner et al. | 439/352 |
| 5,538,437 | 7/1996 | Bates, III et al. | 439/352 |
| 5,547,385 | 8/1996 | Spangler | 439/101 |
| 5,554,045 | 9/1996 | Bethurum | 439/372 |
| 5,580,268 | 12/1996 | Miyazawa | 439/352 |
| 5,586,893 | 12/1996 | Mosquera | 439/108 |
| 5,634,809 | 6/1997 | Hirai | 439/352 |
| 5,683,264 | 11/1997 | Hobgood et al. | 439/352 |

*Primary Examiner*—Paula Bradley
*Assistant Examiner*—Ross Gushi
*Attorney, Agent, or Firm*—Thomas L. Peterson

[57] ABSTRACT

A first connector of the type that has a pair of forwardly-projecting latch arms for locking into a cavity of a second connector, where the latch arms of the first connector have outer sides with slots that hold first auxiliary contacts, and the second connector has slots at opposite sides of its cavity for holding corresponding second auxiliary contacts. Each slot is aligned with a bore in the connector frame, with the bore being of rectangular configuration. Each auxiliary contact includes a plate portion lying in the bore in interference fit with the opposite sides of the bore, a strip portion that extends forward of the plate portion, and a 90° bend that connects one side of the plate portion to an edge of the strip portion.

12 Claims, 5 Drawing Sheets

FIG. 11
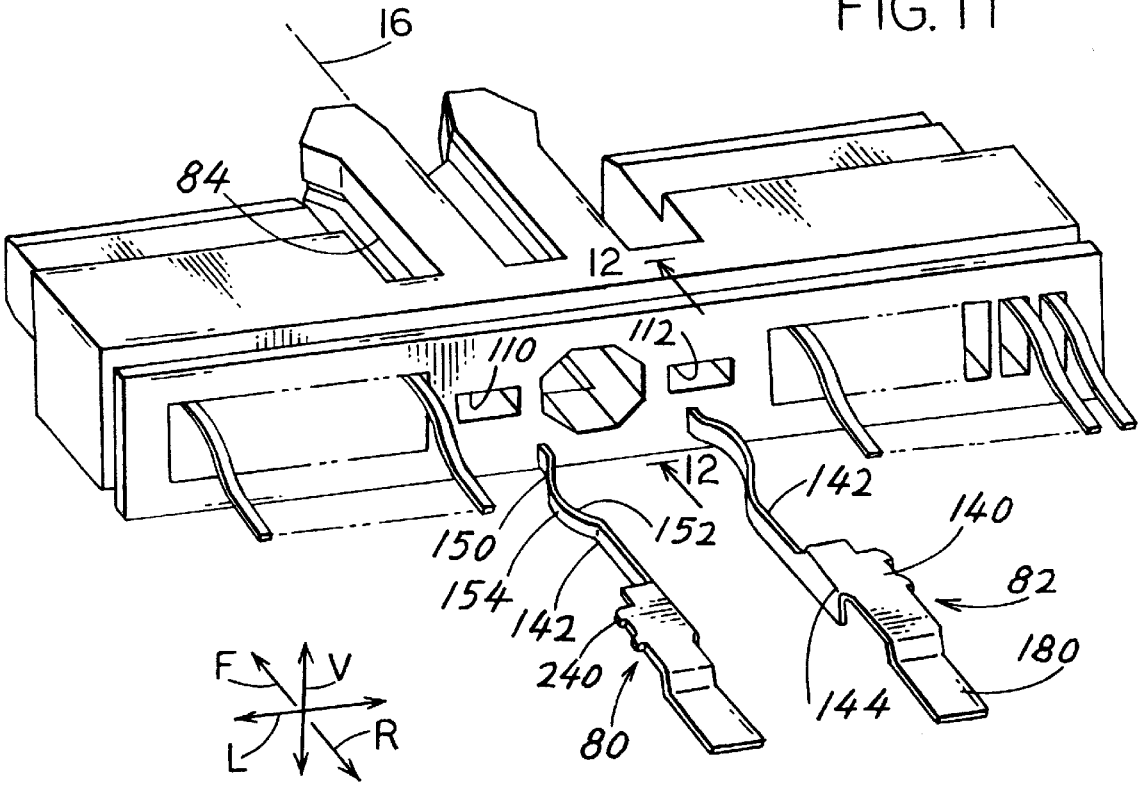
FIG. 12
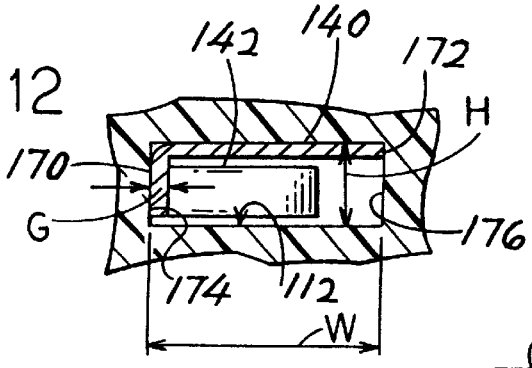
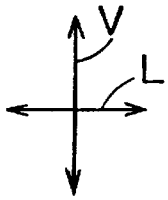
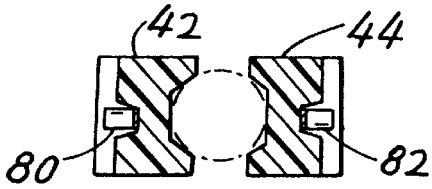
FIG. 13

CONNECTOR LATCH WITH INTEGRATED AUXILIARY CONTACTS

BACKGROUND OF THE INVENTION

One type of miniature connector includes a latching mechanism lying between two rows of data contacts. The latching mechanism includes a pair of forwardly-projecting latch arms that have lugs at their front ends and that are laterally spaced. The latch arms deflect together as they are inserted into a cavity of a mating connector, and a handle can be operated to prevent the latch arms from deflecting together, to thereby lock the connectors together. This type of latching mechanism is shown in the prior art, as in U.S. Pat. Nos. 5,387,110 and 5,411,402.

In addition to transmitting data through the data contacts, it is often desirable to provide additional contacts for transmitting power and/or for grounding the connectors to each other. Such additional connects had generally been provided by separate plugs and sockets. If such additional contacts could be incorporated in the connectors that have rows of small and closely spaced data contacts, with the additional contacts separated from the data contacts and capable of having different sizes than the data contacts, then more versatile miniature connectors would be available.

SUMMARY OF THE INVENTION

In accordance with one embodiment of the present invention, first and second connectors are provided, of the type wherein a first connector has a row of data contacts and has a latching mechanism in the form of a pair of forwardly-projecting latch arms that can be resiliently deflected together and that can be locked apart. The invention provides one or more auxiliary contacts that can be spaced from the data contacts and that can be of a different size, without requiring enlargement of the connectors. The outer sides of the latch arms are provided with slots, and auxiliary contacts each lies in one of the slots. When the connectors are mated, the contacts in the slots engage corresponding second contactsat opposite sides of the cavity of the second connector.

Each of the auxiliary contacts has a mounted part lying in a bore of the frame of the connector. Each bore is of rectangular shape and has a lateral width greater than a vertical height. Each of the auxiliary contacts has a plate portion with laterally-spaced opposites sides in interference fit with the walls of the bore, a strip portion that forms the mating end of the contact, and a right angle bend that connects one side of the plate portion to an edge of the strip portion.

The novel features of the invention are set forth with particularly in the appended claims. The invention will be best understood from the following description when read in conjunction with the accompanying drawings.

BRIEF DESCRIPTION OF THE DRAWINGS

FIG. 11 is a rear and top isometric view of the first connector of FIG. 1, and showing a pair of auxiliary contacts prior to insertion into the first connector.

FIG. 12 is a sectional view taken on line 12—12 of FIG. 11, but with the auxiliary contacts fully installed in the frame of the first connector.

FIG. 13 is a sectional view taken on line 13—13 of FIG. 11.

DESCRIPTION OF THE PREFERRED EMBODIMENTS

Figure 1:
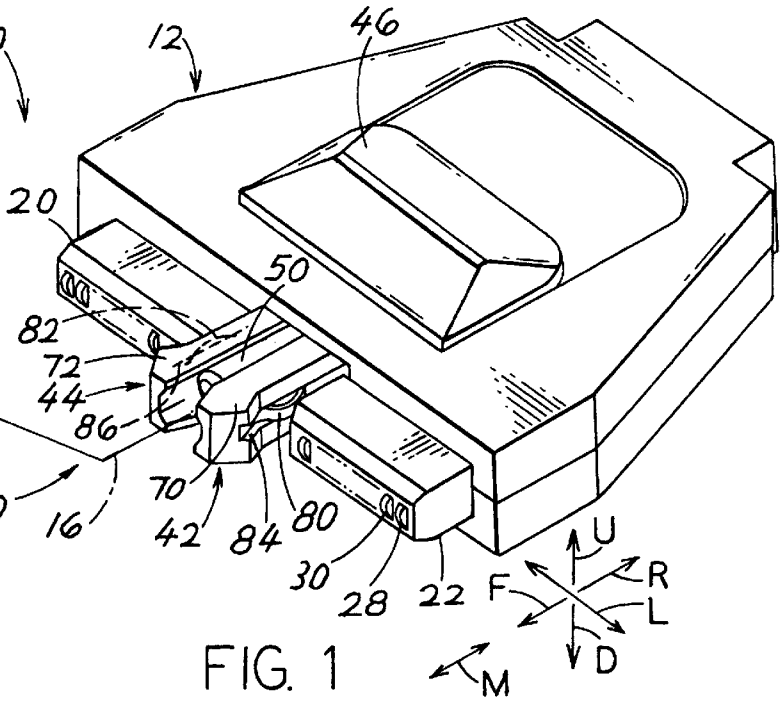
FIG. 1 is an exploded isometric view of first and second connectors of the present invention.

FIG. 1 illustrates a connector system or combination 10 which includes a first connector 12 and a connector device or second connector 14, where the connectors can be mated by moving each connector towards the other along their corresponding axis 16, 18. Both axis extend in front F and rear R longitudinal directions M. A first connector 12 is a plug connector with a pair of plug parts 20, 22 that can be inserted into corresponding recesses 24, 26 of the second connector. Each plug part such as 22 has a row of data contacts 28 with mating ends 30 that engage corresponding data contact mating ends 32 of contacts 33 of the second connector.

The first connector includes a latching mechanism 40 formed by a pair of latch arms 42,44 that are laterally L spaced apart and that can be resiliently deflected closer together and that then spring out to their original positions. A handle 46 can be manually moved back and forth to move a post 50 back and forth. When the post 50 is moved forward, it lies between the two latch arms 42,44 to prevent them from deflecting together in order to lock the latch arms apart. Instead of a post that moves in longitudinal directions M, the post can have projecting cams and can be rotated so the cams press against the latch arms to prevent the latch arms from moving together. Such latch arms are known in the prior art.

The second connector 14 has a rearwardly opening cavity 60 with a narrow rear cavity part 62 and a wider front cavity part 64. With the handle 46 moved to a rearward, unlatching position, the latch arms 42, 44 can be inserted forwardly into the cavity 60 of the second connector. Lateral enlargements or lugs 70,72 at the front ends of the latch arms cause the latch arms to deflect close together as they pass through the narrow rear cavity part 62, the latch arms then springing apart when they reach the wider front cavity part 64. Then, the handle 46 is moved forward to prevent the latch arms from deflecting together, to thereby lock the connectors together.

Figure 3:
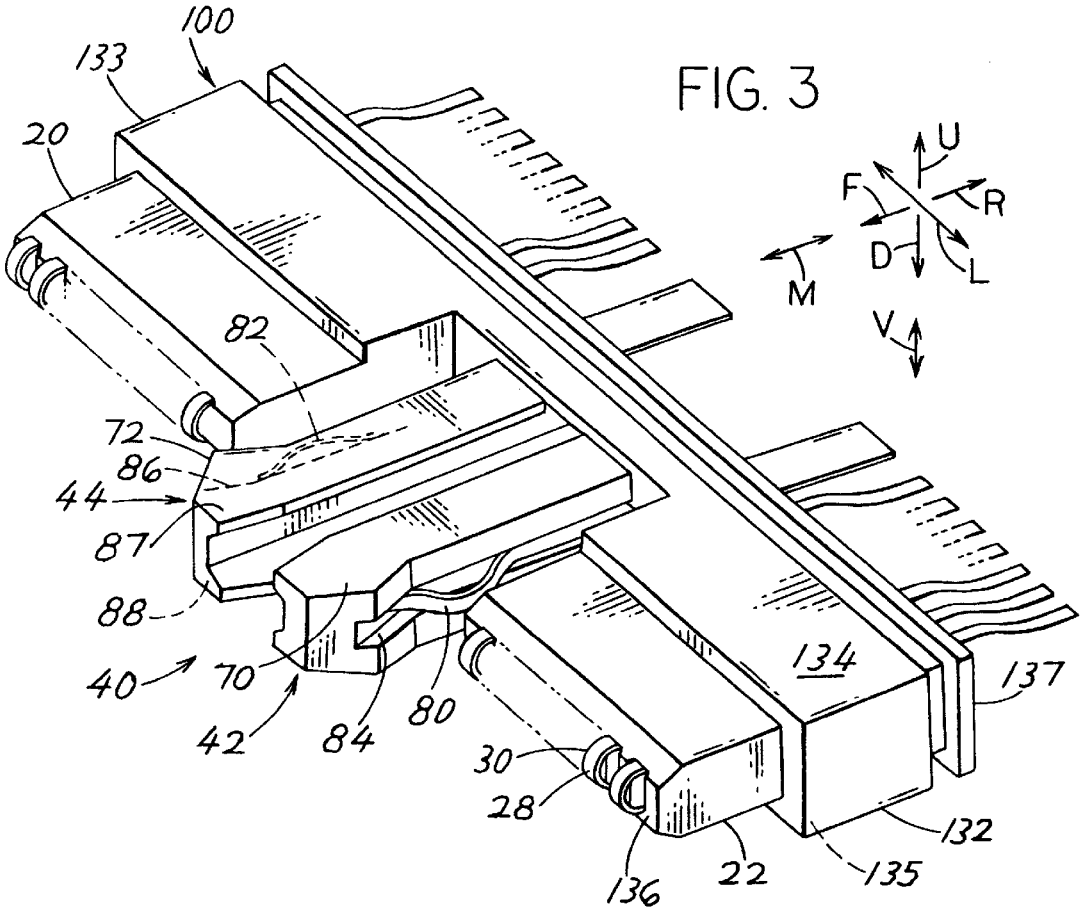
FIG. 3 is an enlarged view of the plug assembly of the connector of FIG. 2
Figure 7:
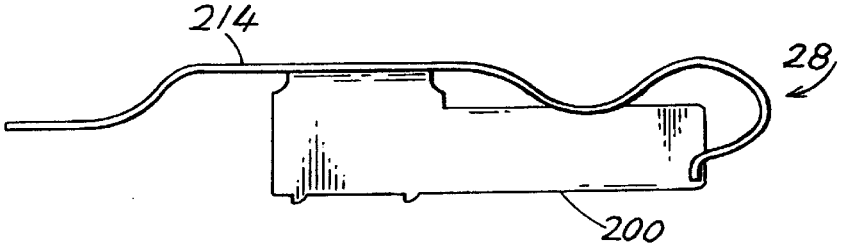
FIG. 7 is a first side elevation view of the contact of FIG. 6.
Figure 8:
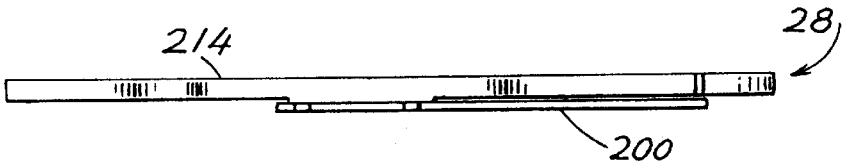
FIG. 8 is a plan view of the contact of FIG. 6.
Figure 9:
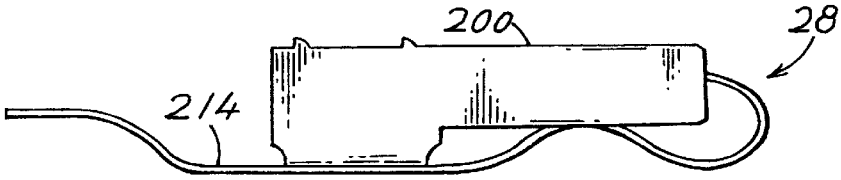
FIG. 9 is a second side elevation view of the contact of FIG. 6.

In accordance with the present invention, applicant provides a pair of first auxiliary contacts 80, 82 on the first connector, as shown in FIG. 3. The first auxiliary contacts 80, 82 have mating ends that lie in slots 84, 86 in outer sides of the latch arms 42, 44. The slots are spaced from the top and bottom surfaces 87, 88 of the latch arms, and preferably lie along the middle of the vertical height of the latch arms to avoid interference with the latching function. The second connector (FIG. 1) has second auxiliary contacts 90, 92 that lie in corresponding slots 94, 96 at laterally opposite sides of the walls of the cavity 60.

Figure 10:
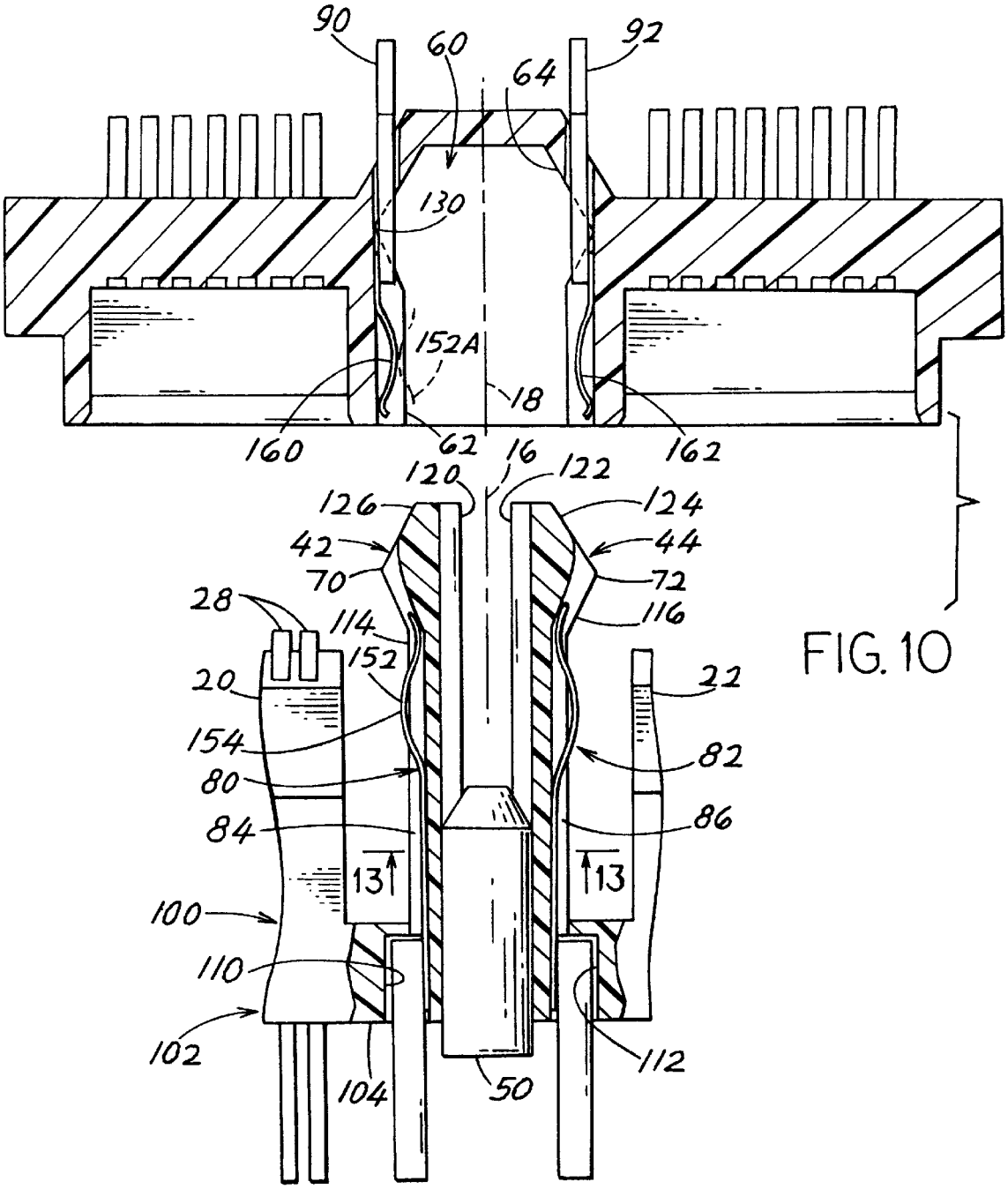
FIG. 10 is an exploded sectional view of the second connector of FIG. 1 and a portion of the first connector of FIG. 1.

FIG. 10 shows that the first connector has a frame 100 of dielectric material with a main part 102 and with the latch arms 42, 44. The main part has a rear portion 104 at the rear of the latch arms, and the frame main part forms the plug parts 20, 22 and passages in the plug parts for holding the data contacts 28. The latch arms 42, 44 are preferably part of the frame and project forwardly from the rear portion 104 of the main part 102. The frame rear part 104 has a pair of bores 110,112 where the auxiliary contacts 80, 82 are fixed in place, and with the auxiliary contacts projecting forwardly along the grooves or slots 84,86 formed in outer sides 114, 116 of the latch arms. The outer sides are the sides furthest from the axis 16 of the first connector, and are the latch arm sides furthest from the other latch arm. The latch arms have inner sides 120, 122 that are closest to the axis and to each other. It can be seen that when the post 50 is moved forwardly to lie between forward portions of the latch arms, the lugs 70, 72 at the forward ends 124,126 of the latch arms cannot deflect together. If the lugs 70, 72 lie in the cavity front part 64 at the widest part 130 of the cavity front part, the lugs prevent separation of the connectors.

FIG. 3 shows that the frame 100 has laterally L opposite sides 132,133, vertically V spaced top and bottom 134, 135, and front and rear ends 136,137. The second connector (FIG. 1) is similarly constructed with a second connector frame device 138 having laterally L opposite sides 139,141, top and bottom, and front and rear ends.

FIG. 11 shows the construction of each of the auxiliary contacts 80, 82.

Each auxiliary contact is formed from a single piece of sheet metal, and includes a plate portion 140, a strip portion 142, and a right angle bent portion or right angled bend 144 that connects the plate portion to the strip portion. As shown in FIG. 12, the plate portion 140 lies in a bore such as 112. Each bore has a height in a vertical direction V and a width in a horizontal lateral direction L that is a plurality of times greater than the height. The strip portions 142 (FIG. 11) project forwardly from the plate portion 140 and form the mating end 150 of each auxiliary contact, including a bow 152 with an apex 154 which is the location on the mating end that is furthest outward away from the axis 16. Much of the strip portion 142 that extends forward of the plate part extends along one of the slots such as 84 in a latch arm. The corresponding second auxiliary contacts 90, 92 (FIG. 10) have inwardly-bowed mating ends 160, 162 for engaging the bowed parts 152 of the first auxiliary contacts. When the connectors are fully mated, the bowed parts at 152 A of the first auxiliary contacts press outwardly against the mating ends such as 160 of the second auxiliary contacts. The reliability of engagement is increased by the fact that the latch arms 42,44 are pressed apart by the locking post 50, which causes the bowed parts 152 of the first contacts to press slightly more firmly against the mating ends 160 of the second auxiliary contacts.

FIG. 12 shows that the plate portion 140 of each auxiliary contact has laterally opposite sides 170, 172 that lie in interference fit with side walls 174, 176 of the bore 112. The bore has a width W that is a plurality of times its height H. The strip portion 142 also has a height in a vertical direction that is a plurality of times the thickness G of the strip. Although it would be possible to extend the strip portion 142 (FIG. 11) rearward to form a tail for sodering to a circuit board, applicant prefers to extend the plate portion 140 rearwardly. This provides more area of contact of the tail 180 with a trace on the circuit board, so that larger currents can be transmitted without high resistance or heating. It should be noted that in most instances, the auxiliary contacts 80, 82 are used to carry power. It is also possible to use the auxiliary contacts for grounding or even for signal-carrying.

Figure 4:
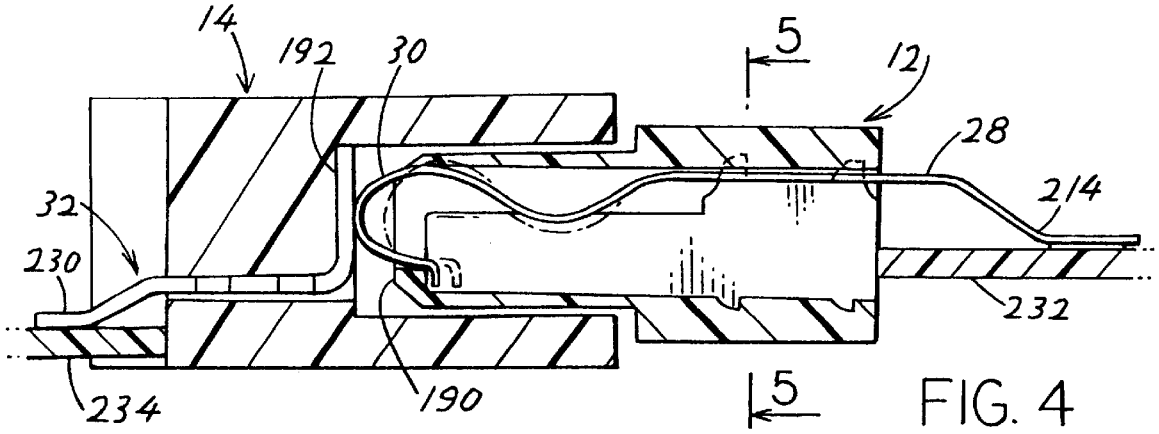
FIG. 4. is a sectional view of the connectors of FIG. 1, showing a pair of mating data contacts at positions just prior to full mating of the connectors.
Figure 5:
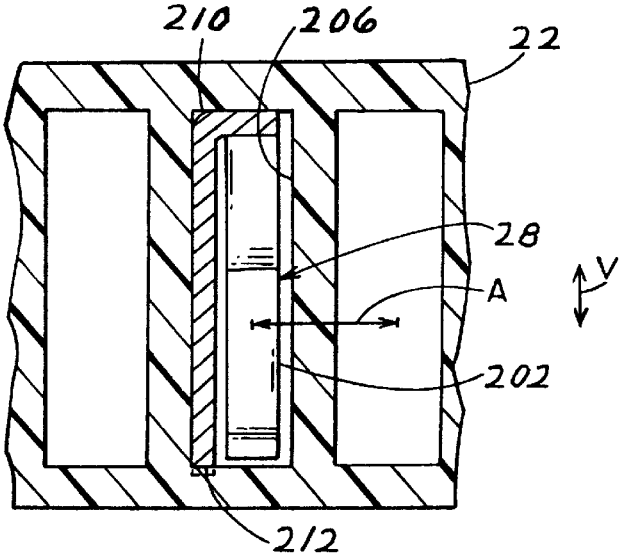
FIG. 5 is a view taken on line 5—5 of FIG. 4.
Figure 6:
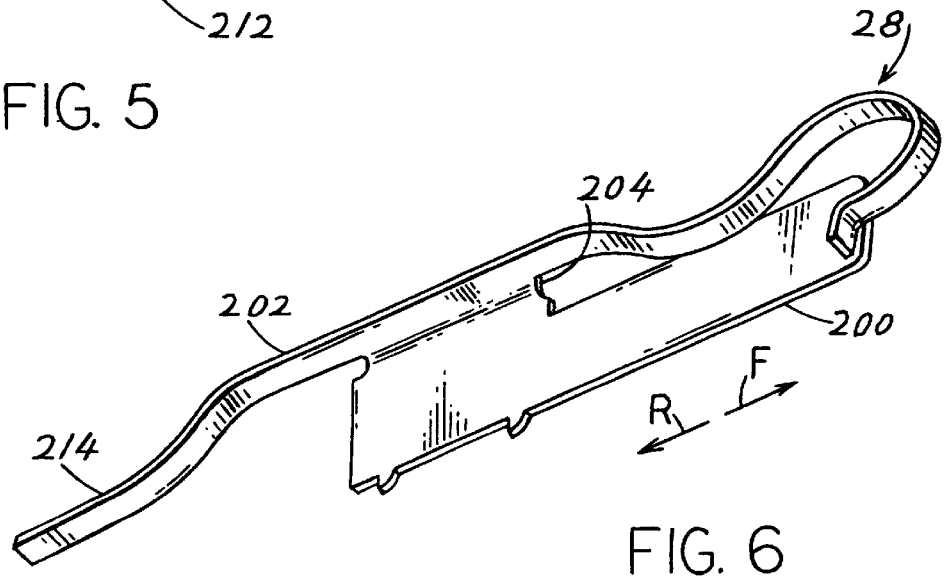
FIG. 6 is a bottom and front isometric view of a data contact of the first connector of FIG. 4.

FIG. 4 show the construction of the first data contact 28 of the first connector 12 and each data contact 32 of the second connector 14. The mating ends 30 of the first contacts extend in loops that project forward of the front end 190 of the first connector frame main part at a local location surrounding the mating end 30 of the first contact. The loop at 30 is compressed against a plate portion 192 of the second data contact. FIG. 6 shows the construction of the first data contact 28, showing that it has a plate portion 200, a strip portion 202, and a right angle bend 204 that connects the plate portion to the strip portion. FIG. 5 shows that the data contact 28 lies in a vertically-elongated passage 206 in the main part of the first connector frame at the plug part 22. The plate portion has top and bottom ends 210, 212 that lie in interference fit with the top and bottom walls of each passage, with the strip portion 202 being free to deflect. FIG. 6 shows that the strip portion 202 of the data contact extends rearwardly and serves as a tail 214 of a connection to a circuit board. The thin tail 214 formed by the strip portion is useful because the data contacts are spaced at a small pitch A such as 0.8 mm, and the thin tails enable soldering to closely spaced traces on the circuit board. It would not be convenient to use the plate portion 200 because the plate portion lies in a vertical plane and would have to be twisted 90° in order to form a broad tail portion for soldering to a circuit board. The first data contacts 213 and first auxiliary contacts such as 80 are of similar constructions, but with the plate portions of the auxiliary contacts extending laterally across their bores instead of vertically.

Figure 2:
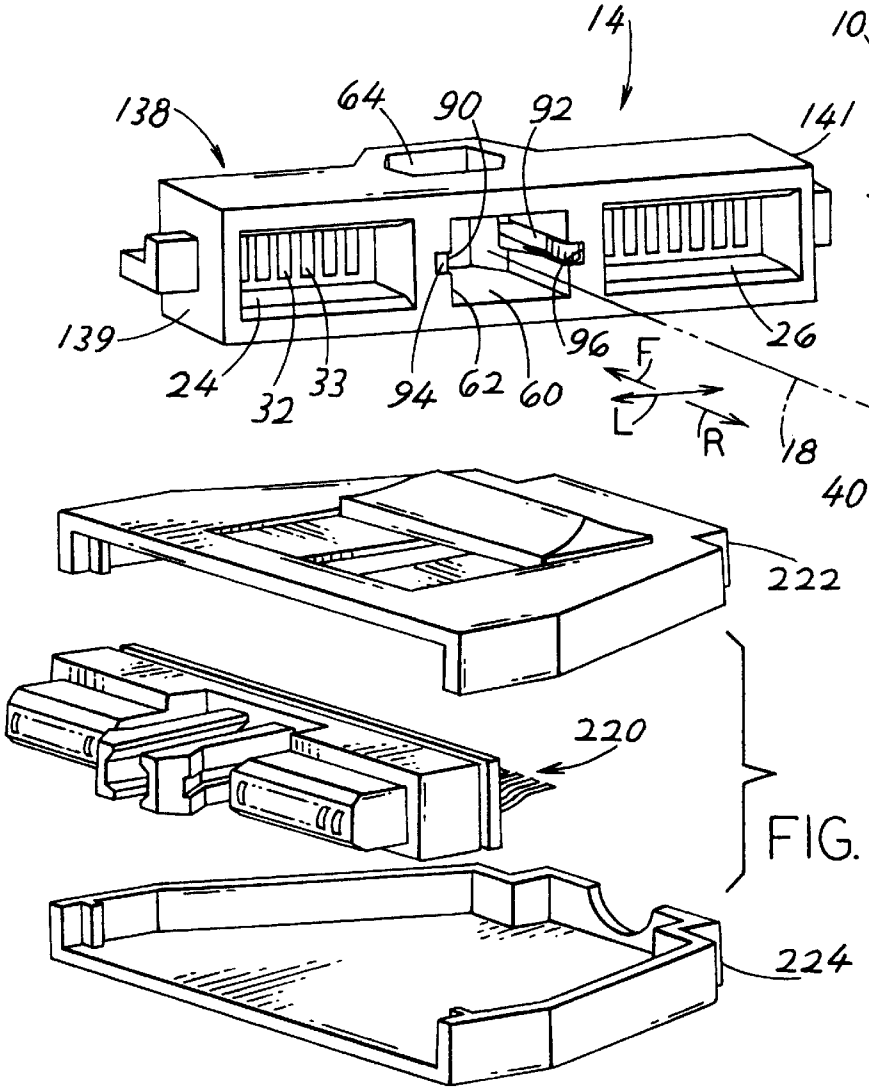
FIG. 2 is an exploded view of the parts of the first connector of the system of FIG. 1.

FIG. 2 shows additional details of the first connector 12, showing that it includes a plug assembly 220 and cover parts 222, 224. FIG. 4 shows that the tails 214, 230 of the first and second data contacts are soldered to traces on circuit boards 232, 234. FIG. 11 shows that each plate portion preferably has barbs 240 that help the plate portion "dig" into a corresponding side wall 176 (FIG. 12) of a bore and help anchor the auxiliary contact in place.

In a connector system that applicant has designed, each first data contact was constructed of sheet metal having a thickness of 0.14 mm, and with each strip portion 202 (FIG. 6) having a width of 0.313 mm. Each auxiliary contact was constructed of sheet metal of 0.14 mm, with each strip portion 142 (FIG. 11) having a width of 0.6 mm. The greater width of the auxiliary contact strip portions provide greater areas of contact and therefore greater current carrying capabilities.

Thus, the invention provides a connector system of the type where a first connector has a latch mechanism in the form of a pair of laterally-spaced latch arms that can be resiliently deflected together, and that lie adjacent to a row of data contacts, which provides at least one and preferably two auxiliary contacts with minimum alterations. Each latch arm has a first slot on its outer surface. The first connector has a pair of first auxiliary contacts with blade portions lying in the first slots. The second contact has corresponding second slots in laterally opposite walls of its cavity that receives the latch arms, and with second auxiliary contacts lying in the second slots. The second slots lie between the top and bottom of the latch arms and of the cavity walls, and do not interfere with operation of the latching mechanism.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector that has a dielectric frame with a main frame portion having laterally spaced sides, vertically spaced top and bottom, and longitudinally-spaced front and rear ends, said frame having a pair of latch arms that project forwardly from said main frame portion and that have laterally-spaced forward ends that can be resiliently deflected closer together, and a locking mechanism that can be manually operated to prevent the arms from deflecting closer together to thereby lock the arm forward ends to a mating connector device, with said latch arms each having an inner side closest to the other latch arm and an outer side furthest from the other latch arm, wherein:

said connector has a pair of auxiliary contact-holding passages that each include a bore projecting longitudinally through said frame main portion and including:

a pair of auxiliary contacts each having a mating end lying at the outer side of one of said latch arms and a rear portion lying at least partially in one of said bores.

2. The connector described in claim 1 wherein:

each of said auxiliary contact-holding passages includes a slot in the outer side of one of said latch arms, with the mating end of each auxiliary contact lying at least partially in one of said slots.

3. The connector described in claim 1 wherein:

said forward ends of said latch arms form outwardly-projecting lugs on their outer sides and the mating end of each auxiliary contact forms a bowed part that is bowed outwardly away from the other auxiliary contact and that has an apex lying furthest from the other auxiliary contact with the apex of each bowed part lying rearward of a corresponding lug.

4. The connector described in claim 1 wherein:

each of said bores is of rectangular cross-section, with a vertical height and with a laterally-extending width that is greater than said height;

each of said auxiliary contacts is formed of a piece of sheet metal and has a plate portion that extends along the width of one of said passages and that has laterally-spaced opposite plate sides, and a strip portion that is connected to said plate portion in a right angle bend at one of said plate sides, with said strip portion having a strip thickness and a strip height that is greater than said strip thickness, with said strip height extending parallel to the height of said passage, and with said strip portion projecting forwardly out of said bore and along said slot and forming one of said auxiliary contact mating ends.

5. The connector described in claim 1 wherein:

each of said bores has laterally opposite bore walls spaced by said width of the bore;

said plate portion lies in an interference fit with said laterally opposite bore walls.

6. The connector described in claim 1 wherein:

said frame main portion has a pair of plug parts on laterally opposite sides of said pair of latch arms, with each plug part having a row of plug passages each extending between said front and near ends of said frame main portion;

a plurality of data contacts that each lies in one of said plug passages;

said plug passages are elongated in a vertical direction while said bores are elongated in a lateral direction;

said signal contacts and said auxiliary contacts each comprises a piece of sheet metal with a plate portion having a plate thickness and having opposite plate edges spaced apart by a plurality of times said plate thickness, a strip portion with a strip thickness and with opposite edges spaced apart by a plurality of times said strip thickness, and a right angle bend that connects an edge of the plate portion to an edge of the strip portion;

said data contacts are each oriented with the opposite edges of its plate being vertically spaced and its strip portion opposite edges being laterally spaced;

said auxiliary contacts are each oriented with the opposite edges of its plate portion being laterally spaced and the opposite edges of its strip portion being vertically spaced.

7. The connector described in claim 1 wherein;

each of said auxiliary contacts has a rearward plate part extending rearwardly from said plate portion and rearward of said main frame portion and forming a solder tail.

8. The connector described in claim 1 including a second connector device that is mateable with said connector, with said second connector device having laterally spaced sides, vertically spaced top and bottom, and front and rear ends, wherein:

said second connector device has a frame device with walls forming a rearwardly opening cavity with rear and front cavity portions for receiving said latch arms, with said cavity front portion constructed to receive said forward ends of said latch arms when said connector and second connector device are fully mated, and with said cavity front portion having a greater lateral width than said cavity rear portion, said cavity walls including laterally spaced cavity side walls;

said frame device has a pair of auxiliary passages that each extends from said front end to said rear end, with each auxiliary passage having a slot portion at one of said cavity side walls with the slot portion opening to said cavity, a pair of auxiliary contact devices that each lies in one of said passages of said frame device and that each has a mating end part that lies at least partially in one of said slot portions to engage a mating end of one of said auxiliary contacts with each slot portion in said second connector device lying at the same height as the mating end of one of said auxiliary contacts.

9. The connector described in claim 2 wherein:

said latch arms have top and bottom surfaces and said slots lie between said top and bottom surfaces.

10. A connector system comprising:

a first connector that has a dielectric frame with a main frame portion having laterally spaced sides and longitudinally-spaced front and rear ends, said frame having latch arms projecting forwardly from said main part, with said latch arms being laterally spaced and resiliently deflectable inwardly toward each other; with said latch arms having front ends with lug portions that each projects outwardly away from the other latch arm, said first connector also having a manually-operable mechanism that prevents said latch arm front ends from moving together;

a second connector which has a second frame with a rearwardly-opening cavity for receiving said latch arms, with said cavity having rear and front cavity portions with said front cavity portion having a rear end forming a pair of shoulders for abutting said lugs, said cavity having laterally-spaced cavity side walls that form said shoulders;

said latch arms have laterally outer sides with at least one of them having a first groove therein, and at least one of said cavity side walls has a second groove that faces said first groove in said latch arm;

a first auxiliary contact mounted in said first connector frame and having a mating end lying at least partially in said first groove, and a second auxiliary contact mounted in said second frame and having a mating end lying at least partially in said second groove.

11. The connector system described in claim 10 wherein:

said main part of said first frame has a longitudinally-extending through bore that is aligned with said first groove, said bore being of rectangular cross-section with side walls spaced by a laterally-extending width and with a vertically-extending height that is less than said laterally-extending width;

said first auxiliary contact comprises a piece of sheet metal with a plate portion having laterally opposite sides in interference fit with said bore side walls, with a strip portion having vertically-spaced edges and a thickness that is less than the distance between said vertically-spaced edges, and a right angle bend that connects one side of said plate portion to one edge of said strip portion.

12. The connector system described in claim 10 wherein:

said mating end of said first auxiliary contact lies rearward of said lugs, and the mating end of said second auxiliary contact lies in said rear cavity portion.

* * * * *